United States Patent [19]

Williams

[11] Patent Number: 4,942,812

[45] Date of Patent: Jul. 24, 1990

[54] DEVICE FOR COMPRESSING EMPTY CANS

[76] Inventor: Joel R. Williams, 124 McKendrie St., San Jose, Calif. 95126-1408

[21] Appl. No.: 327,739

[22] Filed: Mar. 23, 1989

[51] Int. Cl.[5] ..... B30B 1/100; B30B 15/06

[52] U.S. Cl. ..... 100/214; 100/226; 100/240; 100/295; 100/902

[58] Field of Search ..... 100/902, 214, 226, 227, 100/229 R, 240, 244, 245, 246, 295, 94, 98 R

[56] References Cited

U.S. PATENT DOCUMENTS

| | | | |
|---|---|---|---|
| 3,565,351 | 2/1971 | Ross, Jr. | 100/902 X |
| 3,760,718 | 9/1973 | Adornetto | 100/227 |
| 3,889,587 | 6/1975 | Wharton | 100/226 X |
| 3,946,662 | 3/1976 | Ross, Jr. et al. | 100/902 X |
| 4,417,512 | 11/1983 | Engelke | 100/902 X |
| 4,685,391 | 8/1987 | Picker | 100/246 X |

FOREIGN PATENT DOCUMENTS

| | | | |
|---|---|---|---|
| 1237688 | 6/1971 | United Kingdom | 100/902 |

*Primary Examiner*—Harvey C. Hornsby
*Assistant Examiner*—Stephen F. Gerrity
*Attorney, Agent, or Firm*—John J. Leavitt

[57] ABSTRACT

Presented is a can crushing device which may be manually operated by employing a foot-operated piston to impose a compressive force on the end of a can contained within a cylindrical cavity. A handle is provided on the device to stabilize the device and provide a support by which the operator may balance himself during use.

5 Claims, 1 Drawing Sheet

DEVICE FOR COMPRESSING EMPTY CANS

BACKGROUND OF THE INVENTION

1. Field of the Invention.

This invention relates to can crushing devices, and particularly to such a device operated by "foot" power.

2. Description of the prior art.

A preliminary patentability and novelty search has revealed the existence of the following five U.S. Pat. Nos. 4,417,512, 4,442,768, 4,606,266, 4,561,351, 4,133,161.

In recent years there has been a great deal of attention given to the necessity of recycling some of our resources. One of those resources is the aluminum that is used in a variety of cans. Recycling of aluminum cans is encouraged by Government agencies, recyclers, and ecologists. Many states now require a deposit be paid for aluminum cans to thus encourage recycling by providing the prospect of recovering the deposit by redemption of the cans. At least in California, special legislation has been passed that requires acceptance of aluminum cans returned to a recycler and the payment of a specified amount per pound for such cans.

Because of space limitations, the storing of aluminum cans in their extended condition poses a problem. There has thus developed the custom of crushing such cans to reduce their volume, enabling the storage of a give number of crushed aluminum cans in a much smaller space than would be required for the same number of cans in extended form. As indicated in the five U.S. Pat. Nos. noted above, a number of different mechanisms have been designed to facilitate crushing of aluminum cans. None however are similar to the device described herein.

Referring to U.S. Pat. No. 4,133,261, it will be seen that the can crusher disclosed and illustrated by this patent utilizes a piston manipulated by a lever to impose a crushing force on a can which rests on the base of the device between the piston and the base. Stability of the can while it is being crushed by the piston is provided by lugs projecting upwardly from the base around opposite sides of the can. It will of course be apparent that while this device performs essentially the same function as the invention described and claimed herein, it performs such function by a significantly different structure.

U.S. Pat. No. 4,417,512 resembles a "pogo" stick modified to effectively crush a can. In this structure, a semi-cylindrical housing receives the can, which rests on a piston head. The piston head is connected to a rod, and the housing is connected to a laterally extending foot support member. With a can positioned in the cavity formed by the semi-cylindrical housing, downward pressure is imposed on the foot support member, causing the housing to be pulled downwardly while the piston head remains stationary, the can thus being crushed between the top plate of the housing and the piston head. Again, while essentially the same ultimate result is achieved with this device as is achieved by the invention disclosed and claimed herein, it is obvious that such function is performed by a significantly different structure.

U.S. Pat. No. 4,442,768 also relates to a can crushing apparatus adapted to be operated with the feet. Again, while the structure performs the same function as the invention disclosed and claimed herein, there is no logical resemblance in either structure or mode of operation between U.S. Pat. No. 4,442,768 and the subject matter of the invention disclosed and claimed herein.

U.S. Pat. No. 4,561,351 is basically similar to the previous U.S. Pat. No. 4,442,768, but utilizes an additional element that initiates the crushing action on the can which in this structure lies horizontally on the base member. Again, there is no logical correspondence between the structure forming the subject matter of U.S. Pat. No. 4,561,351 and the invention claimed and disclosed herein.

Lastly, U.S. Pat. No. 4,606,266 discloses and illustrates a can crushing device that doubles as an exercise structure. The structure and method of operation of the device illustrated in this patent is obviously different from the subject matter forming the basis for the invention disclosed and claimed herein.

Prior art apparatus utilized to crush cans, including those described and discussed above, have not met wide acceptance in the market place. This is believed to be due to factors relating to cost of manufacture, complexity of use, installation and safety.

One of the problems that continues to arise in connection with the crushing of beverage cans results from the inadvertent attempt to crush full or partly full open cans, and even unopened cans. None of the prior art patents with which I am familiar appear to sufficiently isolate the user from leaking or potentially dangerous spraying cans. Accordingly, one of the important objects of the invention is the provision of a device for crushing cans in which the person operating the device is protected from liquid spraying from a can being crushed.

Another problem that arises in connection with can crushing apparatus is the difficulty of cleaning such apparatus when it has been doused with a beverage contained in a can being crushed. Accordingly, another object of the invention is the provision of a can crushing device that is easily cleaned of any spilled beverage or liquid that might be emitted by a can being crushed.

The question of safety in the crushing of cans is especially important. The cost of liability insurance for devices of this kind can frequently increase the cost to the consumer to such an extent that it makes the device difficult to sell. For example, can crushing structures that involve a pivoted mechanism in which two levered jaws are forced together to crush the can are inherently unsafe for two reasons: (1) fingers or toes can easily be placed in a position to be crushed along with the can, and this is of particular concern if children have access to the device; and (2) the device is subject to instability, particularly if the operating force is applied in an off-center or oblique manner or direction. This can result in the device tipping over, possibly causing the operator to fall, thus placing the operator at risk to injury from such a fall. Accordingly, another important object of the present invention is the provision of a can crushing device that is inherently stable and safe to operate, even by children.

The device for compressing empty cans forming the subject matter of this invention is a useful appliance in residences, work places and out-of-doors, wherever empty beverage cans may be found. Futhermore, it is completely portable and requires no permanent mounting or special storage facility. Additionally, the device may be used for cans made from aluminum or other materials having similar compressibility characteristics.

Because of the prevalence of vending machines that dispense cans of beverages, the prevalence of empty beverage cans in the form of litter in public buildings, public streets and highways and other areas is appalling. The presence of such litter has become so pervasive that authorities in many localities require violators of traffic laws to work along public streets and highways and pick up such litter for proper disposition. Accordingly, it is an important object of the present invention to provide a portable can crushing device that may be carried along on such excursions to facilitate manually compressing aluminum beer and "pop" cans to thereby facilitate their collection and storage.

Another object of this invention is to provide a can crushing device that requires minimum effort to operate, thus allowing operation by a wide range of users, including children.

Still another object of the invention is to provide a device for crushing cans that is easy and obvious to operate so that no training is required.

Yet another object of the invention is to provide a can crusher that maximizes safety to the user.

Can crushing devices of the prior art tend to be so complex as to mitigate against portability and against easy storage of the apparatus. Accordingly, a still further object of the present invention is the provision of a device for crushing cans that possesses extreme portability and which may be easily stored.

Many of the prior art can crushing devices utilize levers and pistons and moving parts that require maintenance. Accordingly, another object of the present invention is the provision of a can crushing device that eliminates the need for maintenance.

For most expedient storage of crushed cans, it is an advantage that the configuration of the crushed can be uniform for successively crushed cans. Accordingly, another object of the present invention is the provision of a can crushing device that incorporates means for controlling the configuration of the compressed can.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the device of the invention for compressing cans comprises a structure that compresses cans by the application of force to opposite ends of the can, while the cylindrical configuration of the can while it is being crushed, is controlled by a surrounding housing. The device broadly comprises a cylindrical shell open at its lower end and provided with a handle that extends upwardly and outwardly and which may be grasped by the hand of the operator to move the device about and to drop the lower open end of the device over a can resting upright on a floor or other supporting surface. Movable axially within the cylindrical shell is a piston having an extension adapted to slidably extend through the upper end of the shell. In use, the shell is dropped over an upstanding can and pushed downwardly until the lower end of the cylindrical shell rests on the same surface on which the can is supported. This action causes the inner head of the piston to come into contact with the top of the can, thus displacing the piston upwardly to its maximum limit as determined by the height of the can. A foot may then be placed on the upper end of the piston extension and downward pressure imposed on the piston to crush the can into a neat cylindrical ingot-like form.

DESCRIPTION OF THE PREFERRED EMBODIMENT

In terms of greater detail, the can crushing device of the invention is preferably fabricated from commercially available materials and components, many of which are used in the plumbing and electrical trades, and many of which may be fabricated from polyvinyl chloride (PVC) or other suitable synthetic resinous material, or combinations of synthetic resinous material and metal, or totally from metal.

The device comprises an outer cylindrical shell 1 conveniently formed from polyvinyl chloride pipe symmetrical about a central axis and having an inside diameter of approximately three inches, and a bushing 2 attached to the upper end of the pipe 1 and having an exterior periphery which is generally the same diameter as the outer diameter of the pipe 1, the bushing having an inner cylindrical periphery of approximately two inches, thus providing a reduction in diameter between the bushing 2 and the inner diameter of the pipe 1. While I have illustrated the bushing as being butt "welded" or fixed to the end of the pipe 1, it will of course be obvious that the outer diameter of the bushing 2 and the inner diameter of the pipe 1 may be gauged so that the pipe 1 slips snugly around the outer periphery of the bushing, where it is "welded" by an appropriate means.

Figure 2:
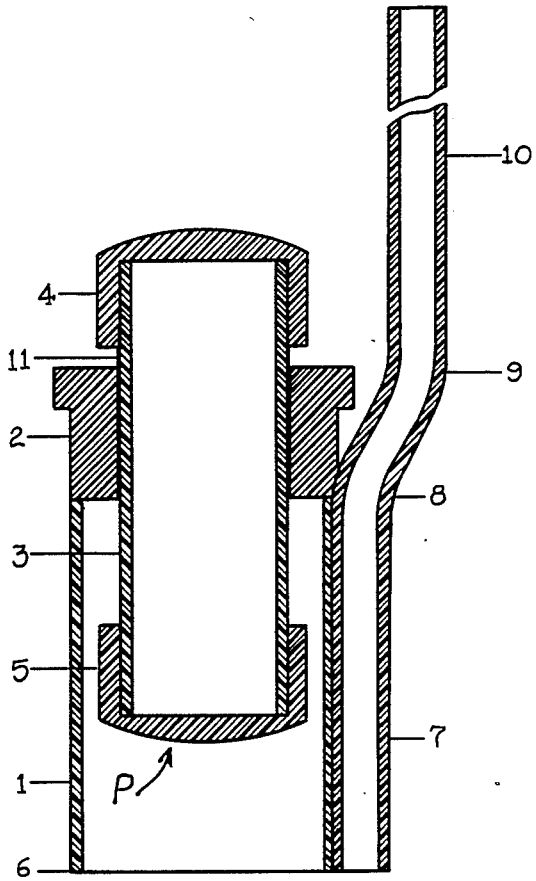
FIG. 2 is a vertical cross-sectional view taken through the central axis of the can crushing device. A portion of the handle is broken away to reduce the height of the view.

A piston mechanism designated generally by the letter P comprises a length of two inch diameter pipe 3 also symmetrical about a central axis, conveniently formed from PVC, and provided at each opposite end with domed end caps 4 and 5, appropriately "welded" to the associated ends of the pipe. The domed end cap 4 closes the upper open end of the pipe, while the domed end cap 5 seals the lower open end of the pipe 3. As illustrated in FIG. 2, the intermediate outer cylindrical periphery of the pipe 3 between the domed end caps 4 and 5 is slidably disposed in the inner periphery of the bushing 2. The end caps 4 and 5 thus limit axial translation of the pipe 3 in relation to the bushing 2, these end caps functioning as mechanical stops to limit such axial displacement of the pipe 3.

Figure 3:
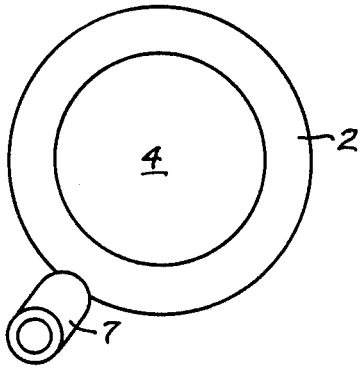
FIG. 3 is a plan view of the structure illustrated in FIG. 1.
Figure 4:
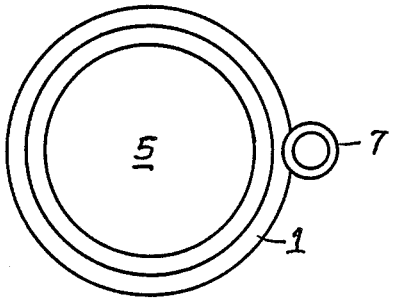
FIG. 4 is a bottom plan view of the structure illustrated in FIG. 2.

To facilitate portability of the device, a handle 7 is provided, the lower portion of the handle being nested in a concave groove formed longitudinally in the outer periphery of the pipe 1 parallel to the central axis, as illustrated in FIGS. 2, 3 and 4, and adjacent its juncture with the bushing 2, the handle is provided with an outwardly displaced bend or jog 8 that merges smoothly with a jog 9 in the handle 7 which enables the remainder of the handle to extend above the pipe 1 a sufficient distance to form a grip portion to be conveniently grasped by the hand of the operator. The handle may conveniently be fabricated from a length of one-half inch PVC pipe and may be fixedly secured in the shallow groove by an appropriate adhesive (not shown) selected for compatibility with the materials being used. Obviously, if the device is fabricated from metal, the handle and pipe 1 may be welded or brazed to one another.

It will thus be seen that the device, while in use, uses the operator's body weight to supply the pressure needed to compress the can. As a result, children weighing as little as forty pounds may operate the device and effectively crush aluminum soft drink and beer cans. The handle 7, extending upwardly from the device, provides a stable hand-hold so that the operator may stand with one foot on the piston head 4 while one hand grasps the grip portion of the handle 7. The operator may thus effectively balance himself while applying the necessary weight to the piston to effectively crush the can disposed between the lower domed head 5 and the surface on which the device is resting.

Because the cavity within which the can is positioned prior to crushing is cylindrical and not much larger than the cylindrical diameter of the can to be crushed, engagement of the lower domed head 5 of the piston with the top of the can provides a centering effect. This, combined with the shape and dimensions of the inner diameter of the cavity formed by the pipe 1, forces the can into a predictable compressed configuration, as it is being crushed.

With respect to safety, the domed end 5 of the piston, centering as it does on the upper end of the can, permits the escape of air from within the can, as it is being crushed, thus eliminating any impedance that trapped air within the can might provide to the crushing opration. It also extends beyond any opening that might be in the can, thus deflecting and containing within the cavity formed by the pipe 1, any liquid that might be forced from the interior of the can being crushed. Thus, while such liquid might spill into the cavity within which the can is contained and from thence onto the floor on which the device is supported, such spilled liquid cannot easily come in contact with the operator of the device. Because of its simplicity and arrangement of parts, the device is maintenance free, may be easily cleaned in the event that liquid is spilled inside of the cavity formed by the pipe 1, and may be easily stored in a broom closet or other convenient place ready for use when needed.

Figure 1:
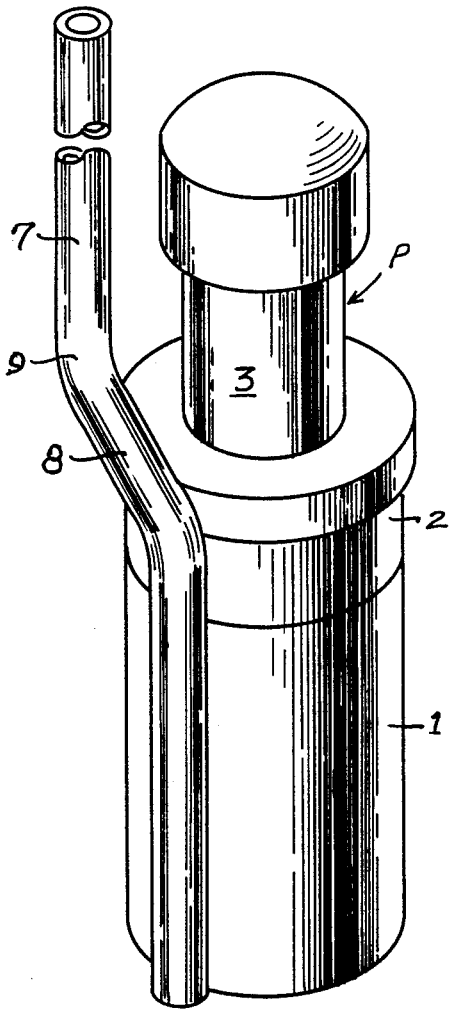
FIG. 1 is a perspective view of the can crushing device of the invention, shown with the piston in its upper operative position. A portion of the handle is broken away to reduce the height of the view.

To use the device to crush a can, all that is necessary is that the can to be crushed be placed on the floor or other surface in an upright position. Using the handle extension 10, the device is picked up and placed over the can so that the can now rests within the cavity formed in the cylindrical pipe 1. In general, the weight of the device when placed over the can will cause the device to move downwardly, placing the lower domed end cap 5 in contact with the top end of the can. The weight of the device will carry it downwardly while the can prevents the piston formed by the pipe 3 from moving downwardly, and the upper end of the piston will therefore assume the position illustrated in FIG. 1.

When the bottom of the cylindrical pipe 1 rests on the floor or other support surface, the operator places his foot on the top domed end cap 4 and applies downward pressure on the piston, causing the piston to be displaced downwardly, and transferring a compressive force to the can. As the can is compressed under the pressure applied by the operator's foot, the inner peripheral sidewalls of the pipe 1 constrain the sides of the compresed can, enabling the crushed can to be formed into a substantially cylindrical ingot-like configuration the axial height of which is controlled by the contact of the upper end cap 4 with the top of the bushing 2. The operator then remove his foot from the device, the device is lifted by the handle extension 10, leaving the compressed can on the floor or other surface, ready to be collected and stored in an appropriate container.

The operator then proceeds to the next can to be crushed. It will thus be seen that with this device, a multiplicity of cans to be crushed may be lined up on a concrete floor, a garage floor, for instance, and the operator may progress from one can to the next along a series of cans, crushing each one in turn until all the cans are crushed. It will be found that all of the crushed cans will be of substantially the same configuration and outer dimension, thus contributing to the facility with which they may be stored and ultimately transported to an approved recyling agency.

Having thus described the invention, what is believed to be new and novel, and sought to be protected by Letters Patent of the U.S. is as follows:

I claim:

1. A device for compressing a collapsible container, comprising:

(a) a cylindrical shell symmetrical about a central axis and open at one end and closed at its opposite end for substantially enclosing the container to be compressed, said cylindrical shell accepting the container through said open end to be compressed and ejecting the compressed container through said open end, and the opposite closed end forming a slide bearing;

(b) a tubular cylindrical piston having end caps on opposite ends, said piston slidably disposed in said slide bearing and including a portion extending within the shell for compressing a container disposed within said shell, said piston including an extension projecting out of the shell closed by one of said end caps and adapted to be depressed by foot pressure; and (c) a handle including a mounting portion attached to the exterior of said shell, said handle also including a grip portion parallel to the central axis of said shell and spaced grasped by an operator of said device to provide stability.

2. The combination according to claim 1, in which said end caps on said piston are provided with domed surfaces.

3. The combination according to claim 1, in which said end cap on the extension of said tubular cylindrical piston projecting out of the shell constitutes a stop to limit translation of said tubular cylindrical piston into said shell.

4. The combination according to claim 1, in which said cylindrical shell is provided with an elongated groove parallel with the central axis of said shell and formed in the exterior surface thereof, and said mounting portion of said handle is nested in said elongated groove, an integral jogged portion of said handle extending away from said shell, said grip portion of the handle being integral with said jogged portion and extending past the closed end of said shell parallel to the central axis thereof.

5. The combination according to claim 1, in which said shell, said piston and said handle are formed from PVC.

* * * * *